US008380095B2

(12) United States Patent
Elad et al.

(10) Patent No.: US 8,380,095 B2
(45) Date of Patent: Feb. 19, 2013

(54) CHARGE DIRECTOR INJECTION SYSTEM

(75) Inventors: Ido Elad, Tel Aviv (IL); Sasi Moalem, Ness Ziona (IL); Gal Amit, Even-Yehuda (IL); Eyal Shelef, Tel-Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 305 days.

(21) Appl. No.: 12/837,852

(22) Filed: Jul. 16, 2010

(65) Prior Publication Data

US 2012/0014704 A1 Jan. 19, 2012

(51) Int. Cl.
*G03G 15/10* (2006.01)

(52) U.S. Cl. ..... 399/57; 399/237

(58) Field of Classification Search ..... 399/57, 399/237

See application file for complete search history.

(56) References Cited

U.S. PATENT DOCUMENTS

| | | | | |
|---|---|---|---|---|
| 6,776,099 | B1 * | 8/2004 | Landa et al. | 399/57 X |
| 6,905,807 | B2 | 6/2005 | Morrison et al. | |
| 7,118,842 | B2 | 10/2006 | Qian et al. | |
| 2003/0016962 | A1 * | 1/2003 | Teraoka et al. | 399/57 |
| 2007/0098425 | A1 * | 5/2007 | Kella et al. | 399/57 |
| 2008/0219687 | A1 * | 9/2008 | Shinichi | 399/60 |
| 2009/0213414 | A1 | 8/2009 | Braverman et al. | |
| 2009/0253068 | A1 | 10/2009 | Golodetz et al. | |

FOREIGN PATENT DOCUMENTS

| | | | |
|---|---|---|---|
| WO | 2008133631 | A1 | 11/2008 |
| WO | 2009001044 | A1 | 12/2008 |

* cited by examiner

*Primary Examiner* — Sophia S Chen

(57) ABSTRACT

A charge director injection system includes a charge director tank, a liquid toner tank, a charge director pump to pump charge director from the charge director tank into the liquid toner tank, and a control system configured to measure a change in charge density per amount of charge director injected into the liquid toner tank, and create a charge profile indicating a relationship between amount of charge director injected into the liquid toner and change in charge density of the liquid toner within the liquid toner tank.

20 Claims, 5 Drawing Sheets

Charge Profile Table
(300)

| Tank Column (302) | Target Charge Density Column (304) | Present Charge Density Column (306) | Change in Charge Density Per Amount Column (308) | Time Column (310) |
|---|---|---|---|---|
| **Tank** | **Target** | **Present** | **Change** | **Time** |
| 1 | 9.8 | 9.8 | .08 | 32 |
| 2 | 8.7 | 8.5 | .07 | 28 |
| 3 | 8.3 | 8.2 | 1.1 | 29 |
| 4 | 9.2 | 8.4 | .09 | 27 |
| 5 | 10.1 | 9.9 | 1.0 | 30 |
| 6 | 9.4 | 9.4 | .08 | 31 |

*Fig. 3*

CHARGE DIRECTOR INJECTION SYSTEM

BACKGROUND

Various printing technologies are used to print images onto a print medium such as paper. One type of printing technology is laser printing. Laser printing works by passing a print medium along a charged photoconductive roller. As the photoconductive roller rotates, a laser is used to remove charge at certain locations along the roller. These locations represent the image to be placed onto the print medium. The locations with removed charge are then rolled passed a development roller having a toner disposed thereon. The toner is given the same charge as the photoconductive roller. The locations where the charge was removed by the laser will pick up the charged toner particles. The toner is then pressed onto the print medium as it passes along the photoconductive roller.

One type of toner is a liquid toner. One example of a liquid toner is Hewlett-Packard Co. ElectroInk® liquid toner. More detail on liquid toners will be given below. In order to give the liquid toners within the liquid toner tanks the appropriate charge, a charge director is injected into the liquid toner tanks. A system of pumps and manifolds are generally used to move the charge director from a charge director tank to the liquid toner tanks. Various inconsistencies between different colors and different types of liquid toners cause the liquid toners to respond differently to the same amount of charge director. This can cause inconsistency between the charge density of the liquid toners over time. This inconsistency in charge density leads to an inconsistency in the amount of liquid toner which is picked up by the photoconductive roller. The inconsistency in liquid toner picked up by the photoconductive roller then leads to a color inconsistency in the image printed onto the print medium.

BRIEF DESCRIPTION OF THE DRAWINGS

The accompanying drawings illustrate various embodiments of the principles described herein and are a part of the specification. The illustrated embodiments are merely examples and do not limit the scope of the claims.

FIG. 3 is a diagram showing an illustrative charge profile table, according to one example of principles described herein.

Throughout the drawings, identical reference numbers designate similar, but not necessarily identical, elements.

DETAILED DESCRIPTION

Figure 1:
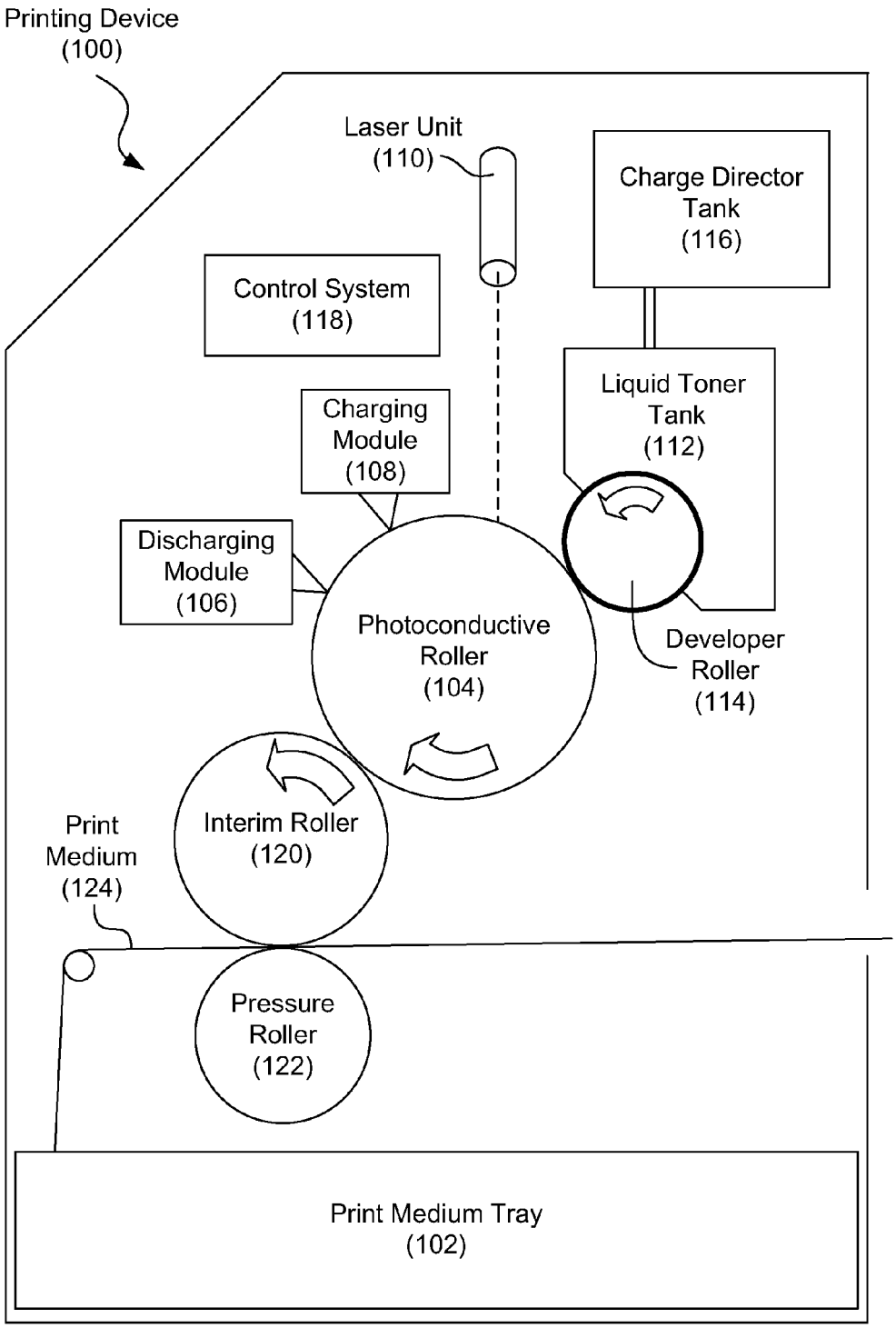
FIG. 1 is a diagram showing an illustrative printing device, according to one example of principles described herein.

As mentioned above, in order to give the liquid toners within the liquid toner tanks the appropriate charge, a charge director is injected into the liquid toner tanks. A system of pumps and manifolds are used to move the charge director from a charge director tank to the liquid toner tanks. Various inconsistencies between different colors and different types of liquid toners cause the liquid toners to respond differently to the same amount of charge director. This can cause inconsistency between the charge density of the liquid toners over time. This inconsistency in charge density leads to an inconsistency in the amount of liquid toner which is picked up by the photoconductive roller. The inconsistency in liquid toner picked up by the photoconductive roller then leads to a color inconsistency in the image printed onto the print medium.

In light of this and other issues, the present specification discloses systems and methods for maintaining the charge density of the liquid toners used by a printing device. These systems and methods include a pump system and a control system for managing the pumps.

According to certain illustrative examples, each liquid toner tank includes its own charge director pump. Each charge director pump is directly connected to the charge director tank. In this manner, the charge director tank itself acts as a manifold. With each liquid toner tank having its own pump, a control system can better control the flow of charge director into each liquid toner tank separately.

As the control system causes the pumps to inject charge director into the liquid toner tanks, the control system can measure the change in charge density per amount of charge director added. This allows the control system to maintain a charge profile for each liquid toner tank. Using this charge profile, the control system can better manage the flow of charge director into the liquid toner tanks to cause each liquid toner tank to maintain a target charge density.

Through use of a system or method embodying principles described herein, a printing system can maintain the charge density of various liquid toners utilized by the printing system. This allows the printing system to produce images with consistent color accuracy.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Throughout this specification and in the appended claims, the term "liquid toner" is to be broadly interpreted as any marking material used by a printing system or printing device to create an image onto a print medium.

Throughout this specification and in the appended claims, the term "charge director" is to be broadly interpreted as a substance which provides charge to another substance when injected into that other substance.

Referring now to the figures, FIG. 1 is a diagram showing an illustrative printing device (100). According to certain illustrative examples, the printing system (100) works by passing a print medium under a photoconductive roller (104). The photoconductive roller (104) uses electric fields to move charged liquid toner to the appropriate positions so as to form an image onto the print medium passing along the photoconductive roller (104). The following will describe the basic operation of the printing system (100).

Under the direction of a control system (118), the process begins as the printing system (100) takes a print medium sheet (124) from the print medium tray (102) and passes the print medium sheet (124) along the photoconductive roller (104).

As the photoconductive roller (104) rotates, a charging module (108) charges the surface of the photoconductive roller (104). In one example, the charging module (108) induces a negative static charge on the surface of the photoconductive roller (104). As the photoconductive roller (104) continues to rotate, a laser unit (110) is used to remove the static negative charge from particular locations of the surface of the photoconductive roller (104). These particular locations form image to be placed onto the print medium sheet passing along the photoconductive roller (104).

The locations where the static negative charge has been removed will then pass along a developer roller (114). The developer roller (114) is coated with a liquid toner received from a liquid toner tank (112). In the present example, the liquid toner is also negatively charged. The liquid toner receives its negative charge from a charge director received from a charge director tank (116). As the negatively charged liquid toner on the development roller (114) move past the statically charged photoconductive roller (104), it will adhere to the surface of the photoconductive roller (104) at locations where the static charge has been removed by the laser unit (110). The charged liquid toner will not adhere to the locations where the photoconductive roller (104) remains charged. This is due to the electromagnetic forces between charged particles.

The liquid toner along the photoconductive roller (104) will then be pressed onto an interim roller (120). The liquid toner which has been pressed onto the interim roller will then press the liquid toner onto a passing print medium (124). The liquid toner will be pressed onto the passing print medium (124) at a nip between the interim roller and the pressure roller (122).

A discharging module (106) is then used to "erase" the static image on the photoconductive roller. The process then continues as the charging module (108) recharges the surface of the photoconductive roller (104).

Liquid toner can provide a number of benefits over dry toner. For example, HP Electroink® dries to form an approximately 90% solid layer which is about 1 μm thick before being transferred to a print medium (124). The thin layer of liquid toner can then be transferred, and simultaneously fused, to the print medium (124). Unlike systems which use a dry toner, in which the dry toner particles are transferred to the paper and then fused at a downstream fuser in a separate operation, liquid toner can be transferred and fused to the print medium in a single operation. Thus, there is no need for a subsequent fusing operation which is common in dry toner printing systems.

The process illustrated and described above shows a printing system which uses one color of liquid toner. Color printing devices typically use three or more colors to produce a color gamut wide enough to produce the desired color images. The complexities associated with applying multiple colors to a print medium using principles described above are beyond the scope of this application. It is sufficient to say that such color systems employ multiple liquid toner tanks filled with different colors of liquid toner.

As mentioned above, it is desirable to maintain the charge density of the liquid toner within the liquid toner tanks. To manage the charge density of the liquid toner within the liquid toner tanks, the present specification discloses a charge director injection system which provides accurate control over the charge density of each liquid toner used by a printing device.

Figure 2:
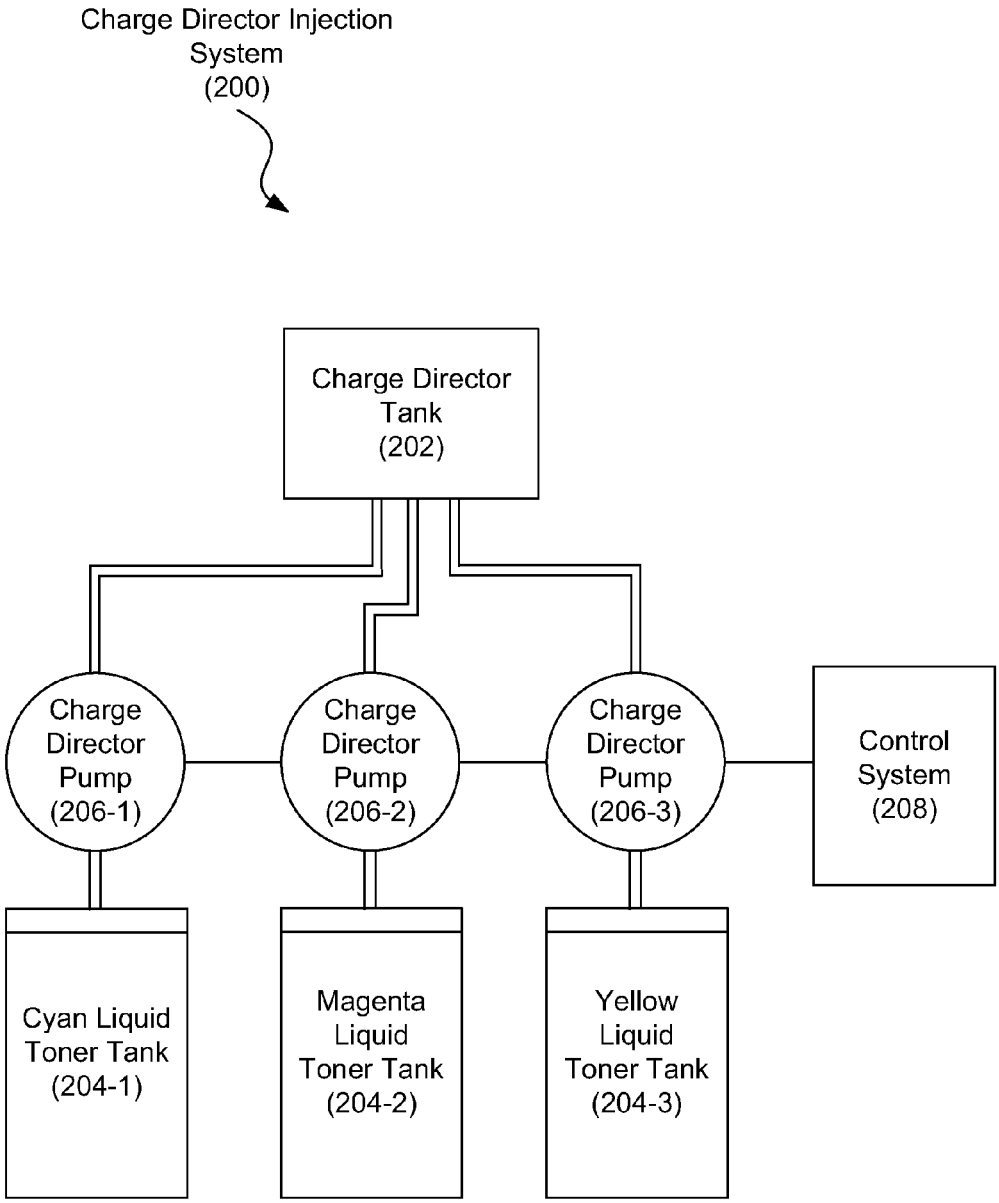
FIG. 2 is a diagram showing an illustrative charge director injection system, according to one example of principles described herein.

FIG. 2 is a diagram showing an illustrative charge director injection system (200). According to certain illustrative examples, the charge direction system includes a number of liquid toner tanks (204), a charge director pump (206) for each of the liquid toner tanks (204) and a charge director tank (202). A control system (208) is used to control the charge director pumps (206) as well as other components of the printing system. This control system may be integrated with or separate from the control system (118) illustrated in FIG. 1.

In the present example, the printing system includes three liquid toner tanks (204). Each liquid toner tank holds a different color of liquid toner. For example, there is a cyan liquid toner tank (204-1), a magenta liquid toner tank (204-2) and a yellow liquid toner tank (204-3). A liquid toner may be made of a number of materials. These materials typically include carrier liquid and pigmented particles. The pigmented particles are what give the liquid toner its color. These particles are typically suspended in the carrier liquid. The pigmented particles are designed so that they do not dissolve within the carrier liquid. In order for the liquid toner to be placed along the photoconductive roller (e.g. 104, FIG. 1) at the appropriate location, the liquid toner must be charged. This is done by injecting a charge director into the liquid toner tanks (204).

A charge director pump (206) associated with each liquid toner tank (204) is used to pump charge director from a charge director tank (202) into the liquid toner tanks (204). Each charge director pump (206) includes its own direct line to the charge director tank. Thus, each charge director pump retrieves charge director directly from the charge director tank (202) without the use of a separate manifold.

With each liquid toner tank (204) having its own charge director pump, the control system (208) is better able to manage the flow of charge director into each liquid toner tank (204). This allows the control system to maintain a consistent charge density within each liquid toner tank. The charge density can be maintained by measuring the change in charge density each time an amount of charge director is added to a liquid toner tank (204). Charge density may be measured by measuring the conductivity of the liquid toner within the liquid toner tank (204). Various pieces of equipment, such as an ohmmeter, can be used to measure the conductivity of liquid toner within a liquid toner tank (204).

By keeping track of the change in charge density per added amount of charge director, the control system (208) can create and maintain a charge profile table for each liquid toner tank (204). This charge profile table can then be used to determine how much charge director should be injected into a liquid toner tank (204) to achieve a desired change in charge density.

FIG. 3 is a diagram showing an illustrative charge profile table (300). According to certain illustrative examples, the charge profile table (300) includes a tank column (302), a target charge density column (304), a present charge density column (306), a change in charge density per change in volume column (308), and a time column (310).

The charge profile table (300) includes data for each liquid toner tank of a charge injection system. In this example, the charge injection system includes six liquid toner tanks numbered 1 through 6. The tank column (302) lists each liquid toner tank by its assigned number.

The target charge density column (304) shows the target charge density for each liquid toner tank. The target charge density can be arbitrarily set based on the characteristics of the liquid toner within the associated liquid toner tank. The numbers shown in FIG. 3 within the target charge density column (304) are for illustrative purposes only and do not necessarily reflect a practical charge density which could be used in a system embodying principles described herein.

The present charge density column (308) shows the present charge density of each of the liquid toner tanks. In some cases the present charge density is at the target charge density. For example, the present charge density of tank 1 is at its target charge density. In some cases, the present charge density is well below the target charge density. For example, the present charge density of tank 4 is well below its target charge density.

The change in charge density per volume of charge director column (308) shows the change in charge density per unit volume of charge director added to the system. The values for this column (308) are derived from the measurements taken by the control system relating to change in charge density per added volume of charge director. In some examples, the data for this column (308) is constructed by averaging the change in charge density per added volume of charge director measured over time. In some cases, this average may be weighted, giving more weight to more recent measurements.

The time column (310) shows the amount of time the pump is required to be in operation to pump the unit volume of charge director into the liquid toner tank. For example, if the unit volume of charge director is 1 milliliter, and it takes 32 seconds to add 1 milliliter of charge director to a liquid toner tank, then the value to be placed in the time column (310) is 32 seconds. In some cases, the control system may measure only the time a pump is in operation and not measure the volume of charge director injected into the liquid toner tank. This may prevent inconsistencies and/or inaccuracies in the hardware used to measure the volume of charge director.

Throughout this specification and in the appended claims, the term "amount of charge director" is to be broadly interpreted as either a volume of charge director or a period of time in which a charge director pump is in operation.

The charge profile table (300) can be updated each time charge director is added to one of the liquid toner tanks. For example, the control system uses the data in the change in charge density per amount of charge director column (308) to bring the charge density of a liquid toner to a target charge density. Thus, the control system will add a specific volume of charge director to a liquid toner tank or operate the charge director pump for a specific period of time. The control system can also measure the change in charge density which resulted from adding the specified amount of charge director into the liquid toner tank. This change in charge density may be slightly different from the expected change in charge density. In this case, the control system can update the charge profile with the newly measured change in charge density per amount of charge director added.

In some cases, updating the charge profile may include a simple replacement of the change in charge density per amount of charge director added. In some cases, updating the charge profile may include updating an average value indicating the average change in charge density per amount of added charge director.

Figure 4:
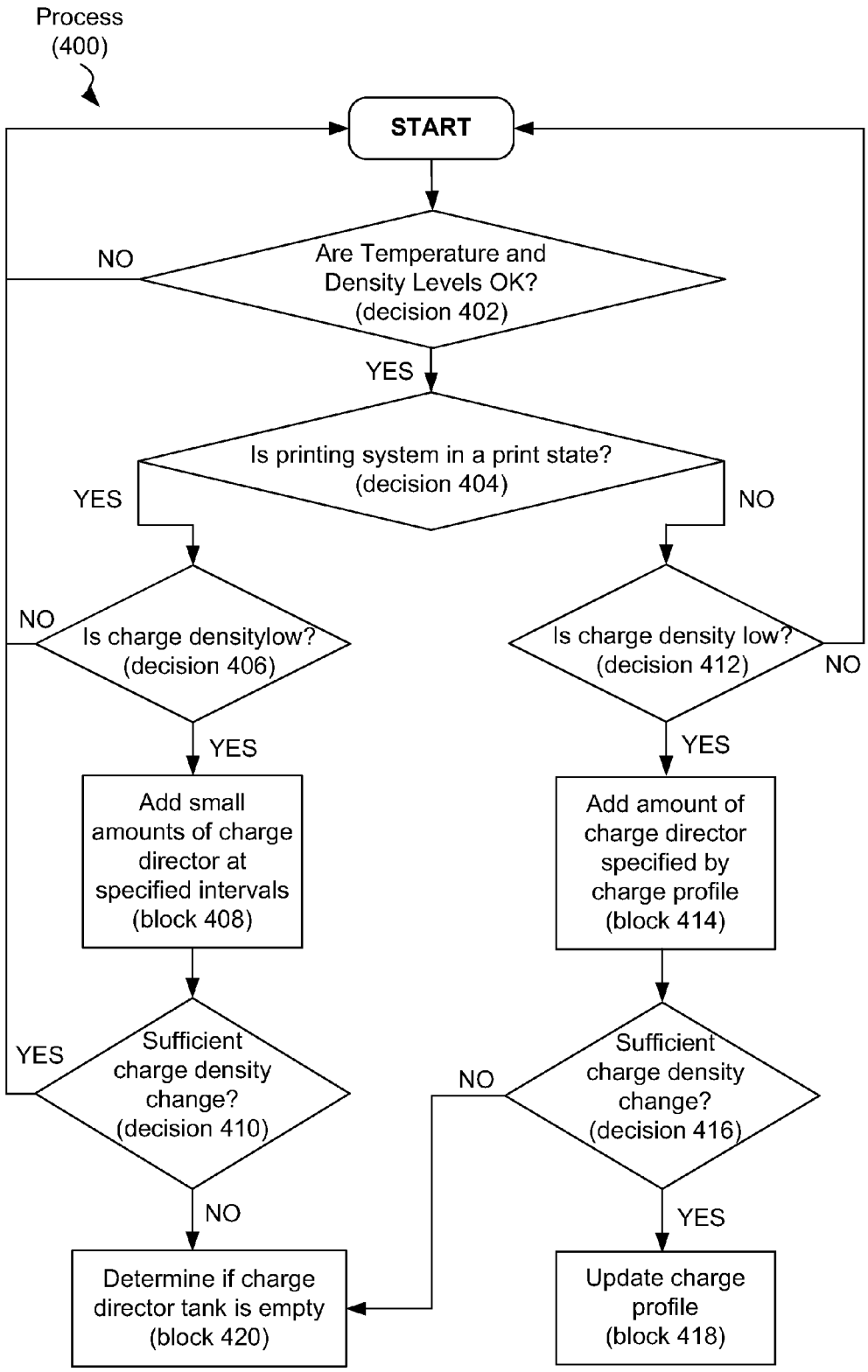
FIG. 4 is a flow chart showing an illustrative operating process for a charge director injection system, according to one example of principles described herein.

FIG. 4 is a flow chart showing an illustrative operating process (400) for a charge director injection system. The example of the process described below will illustrate the use of a single liquid toner tank. However, the principles described below can also be applied to a printing system utilizing multiple types and colors of liquid toners in different liquid toner tanks.

According to certain illustrative examples, the process (400) begins by determining (decision 402) whether or not the temperature and density levels of liquid toner within a liquid toner tank are at appropriate levels. If the temperature and density levels are not (decision 402, NO) at appropriate levels, then the process will wait until the temperature and density levels are indeed (decision 402, YES) at appropriate levels. It is beneficial to wait until the temperature and density levels of the liquid toner are at the appropriate levels required for printing. These levels will affect the charge density measurements. Thus, to maintain consistency between measurements, it is beneficial to wait until the liquid toner is at the appropriate temperature and density levels.

With the liquid toner at the appropriate temperature and density levels, the process (400) will then determine (decision 404) whether or not the printing device is in a print state. Whether or not the printing device is currently printing will affect the manner in which charge director should be injected into the liquid toner tank.

If the printing device is indeed (decision 404, YES) in a printing state, then the process (400) will continue by determining (decision 406) whether or not the charge density level of the liquid toner is too low. If the charge density level is not (decision 406, NO) too low, then nothing needs to be done. If the charge density level is indeed (decision 406, YES) too low, then the control system will cause the charge director pump to add (block 408) small amounts of charge director at specified intervals. While in the process of printing, adding too much charge director at a time may adversely affect the quality of the image produced by the printing system. This is because an abrupt change in charge density will have an abrupt change in color density in the printed image. Consequently, while in a printing state, the control system can be configured to inject smaller amounts of charge director into the liquid toner tank.

The process will then continue by determining (decision 410) whether or not the change in charge density due to the adding of charge director was sufficient. If the change in charge density was indeed (decision 410, YES) sufficient, then nothing needs to be done. If the change in charge density was not (decision 410, NO) sufficient, then the control system can check (block 420) to see if the charge director tank is empty. If the charge director tank is empty, then an administrator can be alerted so that the charge director tank can be refilled. Alternatively, the printing system may include means to automatically refill the charge director tank from a larger change director source.

If the printing device is not (decision 404, NO) in a printing state, then the process (400) will continue by determining (decision 412) whether or not the charge density level of the liquid toner is too low. If the charge density level is not (decision 412, NO) too low, then nothing needs to be done. If the charge density level is indeed (decision 412, YES) too low, then the control system will cause the charge director pump to add (block 414) an amount of charge director according to the charge profile. While the printing device is not in a printing state, it does not matter if there is an abrupt change in charge density. Thus, the control system may add the appropriate amount of charge density according to the charge profile without regard to abrupt changes in charge density.

The process will then continue by determining (decision 416) whether or not the change in charge density due to the adding of charge director was sufficient. If the change in charge density was indeed (decision 416, YES) sufficient, then the change in charge density is measured and the charge profile is updated (block 418) with the newly measured change in charge density. If the change in charge density was not (decision 416, NO) sufficient, then the control system can check (block 420) to see if the charge director tank is empty.

Figure 5:
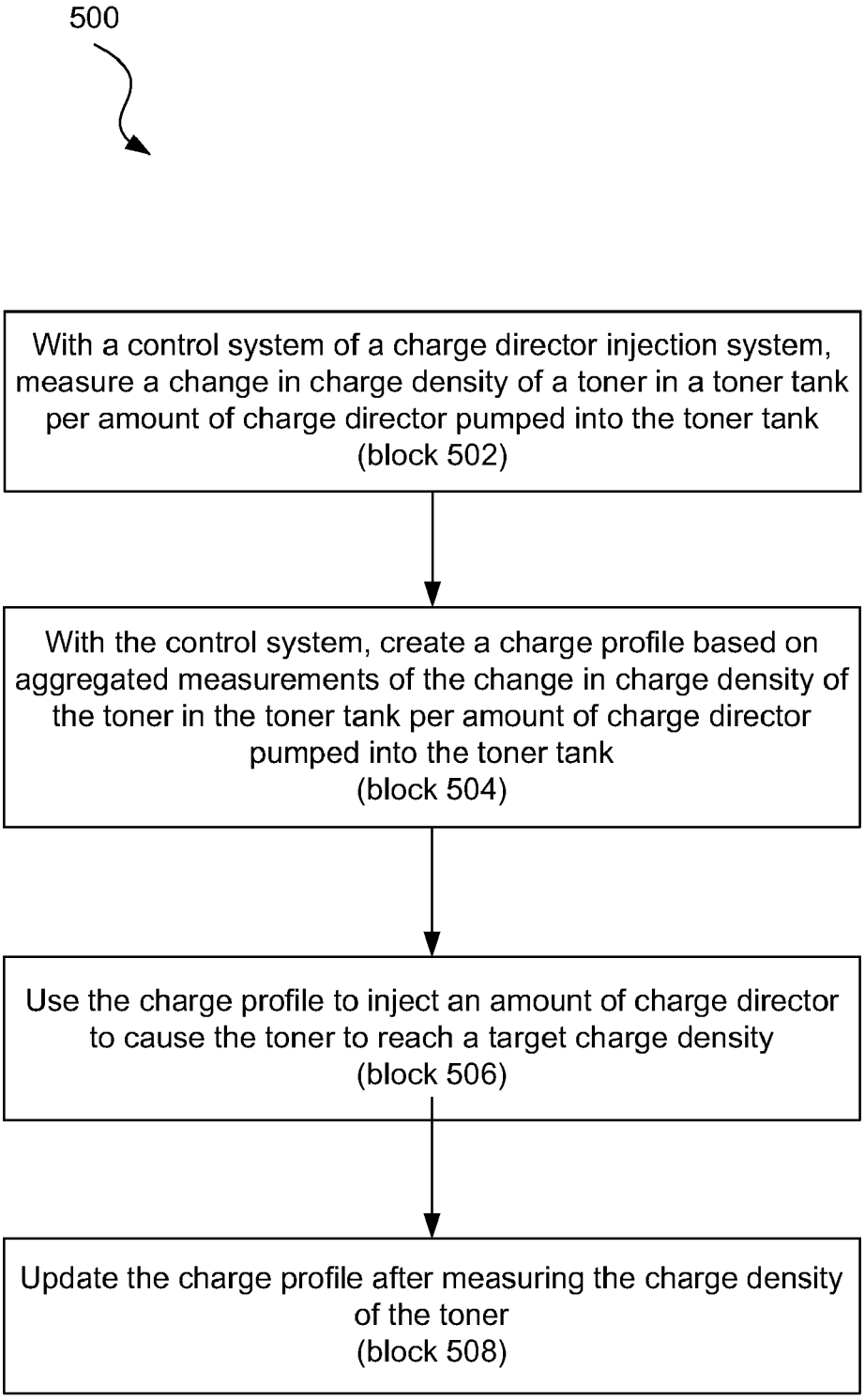
FIG. 5 is a flow chart showing an illustrative method for maintaining the charge density of liquid toner, according to one example of principles described herein.

FIG. 5 is a flow chart showing an illustrative method for maintaining the charge density of a liquid toner. According to certain illustrative examples, the method (500) includes, with a control system of a charge director injection system, measuring (block 502) a change in charge density of a liquid toner in a liquid toner tank per amount of charge director pumped into the liquid toner tank; with the control system, creating (block 504) a charge profile based on aggregated measurements of the change in charge density of the liquid toner in the liquid toner tank per amount of charge director pumped into the liquid toner tank; using (block 506) the charge profile to inject an amount of charge director to cause the liquid toner to reach a target charge density; and updating (block 508) the charge profile after measuring the charge density of the liquid toner.

In conclusion, through use of a system or method embodying principles described herein, a printing system can maintain the charge density of various liquid toners utilized by the printing system. This allows the printing system to produce images with consistent color accuracy.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A charge director injection system comprising:
a charge director tank;
a liquid toner tank;
a charge director pump to pump charge director from said charge director tank into said liquid toner tank; and
a control system configured to:
measure a change in charge density per amount of charge director injected into said liquid toner tank; and
create a charge profile indicating a relationship between amount of charge director injected into a liquid toner and change in charge density of said liquid toner within said liquid toner tank.

2. The system of claim 1, in which said control system is configured to use said charge profile to maintain a target charge density of said liquid toner within said liquid toner tank.

3. The system of claim 1, in which said control system is configured to update said charge profile when injecting additional charge director and measuring a new change in charge density of said liquid toner within said liquid toner tank.

4. The system of claim 3, in which to update said charge profile, said control system is configured to replace an old change in charge density per amount of charge director injected into said liquid toner tank with a new change in charge density per amount of charge director injected into said liquid toner tank.

5. The system of claim 3, in which said charge profile comprises an average change in charge density of said liquid toner within said liquid toner tank per amount of injected charge director.

6. The system of claim 1, further comprising additional liquid toner tanks, each additional liquid toner tank corresponding to an additional charge director pump, each of said charge director pumps connected to said charge director tank.

7. The system of claim 6, in which said control system is configured to control each of said charge director pumps separately.

8. The system of claim 6, in which said control system is configured to maintain a unique charge profile for each of said charge director pumps.

9. A printing device comprising:
a print medium supply to provide print medium sheets to an interim roller, said interim roller receiving liquid toner from a photoconductive roller, said photoconductive roller receiving said liquid toner from a development roller, said development roller receiving said liquid toner from a number of liquid toner tanks;
a charge director injection system comprising:
a charge director tank;
a number of charge director pumps, each charge director pump associated with one of said number of liquid toner tanks, said charge director pumps being used to pump charge director from said charge director tank into said liquid toner tanks; and
a control system configured to:
measure a change in charge density per amount of charge director injected into said liquid toner tanks; and
create a charge profile for each of said liquid toner tanks, said charge profile indicating a relationship between amount of charge director injected into said liquid toner tanks and change in charge density of said liquid toner within said liquid toner tanks.

10. The device of claim 9, in which said control system is configured to use said charge profiles to maintain a target charge density of said liquid toner within said liquid toner tanks.

11. The device of claim 9, in which said control system is configured to update said charge profiles after measuring said change in charge density of said liquid toner within said liquid toner tanks.

12. The device of claim 11, in which to update said charge profiles, said control system is configured to replace an old change in charge density per amount of charge director injected into said liquid toner tanks with a new change in charge density per amount of charge director injected into said liquid toner tanks.

13. The device of claim 11, in which said charge profiles comprise an average change in charge density of said liquid toner within said liquid toner tanks per amount of injected charge director.

14. The device of claim 11, in which said control system controls each of said charge director pumps separately.

15. The device of claim 14, in which said control system maintains a unique charge profile for each of said charge director pumps.

16. A method for managing a charge density of liquid toner within a liquid toner tank, the method comprising:
measuring a change in charge density of a liquid toner per amount of charge director pumped into said liquid toner; and
creating a charge profile based on aggregated measurements of said change in charge density of said liquid toner per amount of charge director pumped into said liquid toner.

17. The method of claim 16, further comprising updating said charge profile after measuring said charge density of said liquid toner.

18. The method of claim 17, in which to update said charge profile comprises replacing an old change in charge density per amount of charge director injected into said liquid toner with a new change in charge density per amount of charge director injected into said liquid toner.

19. The method of claim 16, further comprising, using said charge profile to inject an amount of charge director to cause said liquid toner to reach a target charge density.

20. The method of claim 16, in which said charge profile comprises an average change in charge density of said liquid toner per amount of injected charge director.

* * * * *